United States Patent [19]

Scheidweiler

[11] 4,405,919

[45] Sep. 20, 1983

[54] METHOD OF FIRE DETECTION AND FIRE DETECTION INSTALLATION

[75] Inventor: Andreas Scheidweiler, Uerikon, Switzerland

[73] Assignee: Cerberus AG, Männedorf, Switzerland

[21] Appl. No.: 257,783

[22] Filed: Apr. 27, 1981

[30] Foreign Application Priority Data

May 9, 1980 [CH] Switzerland ..... 3640/80

[51] Int. Cl.[3] ..... G08B 17/10

[52] U.S. Cl. ..... 340/522; 340/587; 340/628; 340/629; 340/630

[58] Field of Search ..... 340/522, 526, 587, 588, 340/589, 629, 630, 584, 628

[56] References Cited

U.S. PATENT DOCUMENTS

| | | | |
|---|---|---|---|
| 3,717,862 | 2/1973 | Sasaki | 340/629 X |
| 3,909,813 | 9/1975 | Scheidweiler et al. | 340/629 X |
| 4,225,860 | 9/1980 | Conforti | 340/629 |
| 4,288,790 | 9/1981 | Schnell | 340/630 X |
| 4,316,184 | 2/1982 | Nagel | 340/628 |

FOREIGN PATENT DOCUMENTS

| | | | |
|---|---|---|---|
| 2108707 | 9/1972 | Fed. Rep. of Germany | 340/630 |
| 2452839 | 5/1975 | Fed. Rep. of Germany | 340/629 |
| 571259 | 12/1975 | Switzerland | 340/629 |
| 2067749 | 7/1981 | United Kingdom | 340/588 |

*Primary Examiner*—Glen R. Swann, III
*Attorney, Agent, or Firm*—Werner W. Kleeman

[57] ABSTRACT

A fire alarm installation possessing increased intelligence which enables differentiating between smoldering fires and fires having open or licking flames. This capability is obtained in that the fire alarm installation possesses two sensor elements working according to different functional principles and an evaluation circuit contains circuit elements which form the quotient of the signals received from both sensor elements. The different sensor elements can be united in a single fire alarm housing which simultaneously contains the evaluation circuit.

18 Claims, 5 Drawing Figures

METHOD OF FIRE DETECTION AND FIRE DETECTION INSTALLATION

BACKGROUND OF THE INVENTION

The present invention relates to a new and improved method of fire detection and an improved construction of fire detection installation.

Generally speaking, the method for fire detection and the fire detection installation of the present development rely upon an arrangement of the type comprising at least two sensor or feeler elements possessing different operating or functional principles and a common evaluation circuit for the evaluation of the changes in the conditions of the sensor elements and for triggering or giving an alarm. Preferably, one of the sensors is a photoelectric transducer and the second sensor either comprises a second photoelectric transducer operating according to a different principle or an air-accessible ionization chamber.

Fires which cause damage and arise in practice can be basically classified into two categories, namely smoldering fires and open fires i.e. those with licking or uncontrolled flames. In the case of smoldering or slowly burning fires there is further differentiated between the so-called pyrolytic fires and glow fires. Pyrolytic fires require for the sustaining thereof a continuous infeed of energy in the form of heat, whereas the glow fires, once ignited, automatically further develop.

Depending upon the nature of the fire it is necessary to undertake different counteractive or fire fighting measures. In the case of smoldering fires life-saving measures take priority, since, as a general rule, there has not yet arisen any considerable property damage and because of the impending danger of suffocating or becoming overcome by smoke inhalation all endangered human beings or occupants must be encouraged to depart from the endangered area or region. On the other hand, in the case of fires having open or licking flames of predominant importance is extinguishing the fire, since considerable property damage will result, and frequently the saving of human life necessitates resorting to outside assistance. The ever growing population density and the increasing accumulation of valuable personal properties in buildings make it more and more desirable to cut down the time until there are implemented the requisite counteractive or fire fighting measures. Furthermore, the access of fire fighting equipment to the site of the fire, in many instances, is markedly hindered by traffic conditions, resulting in the fire fighting personnel frequently arriving too late at the site of the fire. Therefore, it becomes increasingly more important that the alarms which are received from the fire alarm or fire detection equipment enable recognition of the type of fire which is being encountered.

The heretofore known automatic fire alarm installations generally contain a sensor or feeler element which responds to combustion phenomena as well as an evaluation circuit which evaluates the electrical signal delivered by the sensor element for alarm signalling or triggering purposes.

Most of the heretofore known fire alarm installations give or trigger an alarm whenever the signal delivered by the sensor element exceeds a set threshold value, or there is possibly evaluated the change as a function of time of the sensor signal (differential fire alarm). It also has already been proposed to combine a number of sensors having different functional principles in a detector, in order to increase the sensitivity and to reduce the danger of false alarms. In German Pat. No. 2,452,839 there has been proposed a fire alarm containing at least two sensors responding to different combustion phenomena and provided with a common evaluation circuit, in order to evaluate the state or condition changes of the sensors and for triggering an alarm signal. In this case the evaluation circuit, after the one sensor has been affected by a combustion phenomenon or fire, is capable of changing the response threshold of the other sensor for triggering an alarm signal in the sense of causing a sensitivity increase of such other sensor. With the heretofore known fire alarm installations there, however, does not exist any possibility of detecting the type of fire which has been encountered. In consideration of the possible selection of the fire fighting or counteractive measures which may be required this information however is frequently of decisive importance.

SUMMARY OF THE INVENTION

Therefore, with the foregoing in mind it is a primary object of the present invention to provide a new and improved method of fire detection and an improved fire detection installation which is not associated with the aforementioned shortcomings and drawbacks of the prior art proposals.

Another and more specific object of the present invention aims at eliminating or essentially suppressing the previously described drawbacks of the state-of-the-art fire alarm installations and, in particular, providing a new and improved construction of fire alarm installation which renders possible recognition, from the obtained signals, of the type or nature of the fire or combustion process which has been encountered i.e. differentiating between a fire having open flames and a smoldering fire and also, if desired, detecting when a fire or combustion process changes from the smoldering phase into the open fire or flame phase.

Yet a further significant object of the present invention aims at providing a new and improved fire detection installation which is relatively simple in construction and design, extremely economical to manufacture, reliable in operation, not readily subject to breakdown or malfunction, and requires a minimum of maintenance and servicing.

Now in order to implement these and still further objects of the invention, which will become more readily apparent as the description proceeds, the fire alarm installation of the present development is of the type comprising at least two sensor or feeler elements having different functional or operating principles and a common evaluation circuit for evaluation of the property changes of the sensor elements and for triggering a signal. The evaluation circuit contains circuit elements which form the quotient of the signals received from the two sensor elements and produce an alarm signal when the quotient exceeds a predetermined value or when there prevails a rapid change in the quotient.

According to a preferred constructional embodiment of the inventive fire alarm one of the sensor elements contains an air-accessible ionization chamber and a second sensor element contains a photoelectric transducer operating according to the extinction principle.

According to another preferred exemplary embodiment one of the sensor elements possesses an air-accessible ionization chamber, whereas a second sensor element possesses a photoelectric transducer which operates according to the scattered light principle.

According to a third preferred embodiment one of the sensor elements comprises a photoelectric transducer operating according to the extinction principle and a second sensor element comprises a photoelectric transducer which operates according to the scattered light principle.

A further preferred embodiment of the inventive fire alarm installation resides in the features that the sensor or feeler elements operating according to different functional principles are connected with an amplifier element and arranged in a fire alarm or detector, i.e. in each case a sensor element together with related amplifier circuit is arranged within a respective five alarm housing, and a common evaluation circuit is arranged at a central signal station. Preferably, in each case two sensor elements having different functional or operating principles are arranged neighbouring one another at a region which is to be monitored and are connected in pairs by means of lines or conductors with a central signal station. The common evaluation circuit is arranged at the central signal station.

Also, it can be advantageous to arrange two sensor or feeler elements having different functional principles conjointly in a single fire alarm housing. The common evaluation circuit is either arranged at a central signal station or is located in conjunction with the sensor elements in the fire alarm housing, wherein, for instance, by means of a multiplex circuit arrangement there can be transmitted for display or indication purposes to the central signal station both the instantaneous values of the sensor element signals and also the quotient of the instantaneous signals obtained from both sensor elements.

According to a particularly preferred constructional embodiment two sensor elements having different functional principles are conjointly arranged along with a multiplex-circuit arrangement or device, transmitting the instantaneous values of the sensor element signals to the central signal station, in a fire alarm housing. At the central signal station or central station there are provided circuit elements which, upon exceeding a predetermined value of the instantaneous values of the sensor elements, give an alarm signal, as well as further circuit elements which form the quotient of the instantaneous signals obtained from both sensor elements and upon exceeding a predetermined value of such quotient deliver an alarm signal which is different from the first alarm signal.

A further particularly preferred embodiment of the fire alarm installation according to the invention resides in the features that two sensor elements or feelers possessing different functional or operational principles are arranged in a fire alarm housing in conjunction with a respective amplifier circuit, a discriminator, a quotient former and a multiplex-transmission circuit, transmitting the instantaneous values of the feeler or sensor elements and the quotients formed from the signals of the sensor elements to the central signal station. At the central signal station there are arranged circuit elements which produce an alarm signal when the instantaneous values of the signals of the sensor elements exceed a predetermined value or threshold, as well as circuit elements which produce an alarm signal differing from the first signal when the quotient of the signals delivered by both sensor elements exceeds a predetermined value or threshold.

Preferably, at the evaluation circuit there are provided circuit elements which, when the sensor element signals exceed a predetermined value and when the quotient of the sensor signal elements exceeds a predetermined value, generate different signals which are transmitted by the multiplex-transmission circuit to the central signal station.

Furthermore, there are preferred fire alarm installations possessing circuit elements which suppress the quotient formation when the absolute value of the sensor element signals remain below predetermined values.

In most fires or combustion processes there do not yet appear any open or uncontrolled licking flames during the incipient stage. As a consequence of the still incomplete combustion there is predominanatly formed dense smoke or fumes and smoke. Considered physically such mixture constitutes an aerosol composed of suspension particles in a microscopic or submicroscopic particle or grain size range. The particle or grain size distribution—in this connection there is also referred to "particle size spectrum" or "particle spectrum"—is less dependent upon the nature of the combustible material than upon the nature of the combustion process itself. In particular, there have been found characteristic changes in the particle or grain size distribution during the course of the combustion process or fire. In the incipient stage of a fire there are predominantly formed relatively large size particles (visible smoke). Upon transition of the smoldering fire into an open fire the combustible material is completely combusted due to the action of the increased heat, and there are predominantly formed submicroscopic particles (invisible smoke). The recognition of the different particle sizes therefore enables differentiating between a smoldering fire and an open fire and the transition from the smoldering fire phase into the open fire phase.

The heretofore known fire alarm installations, containing smoke detectors, essentially operate in accordance with two functional principles. In the case of ionization fire alarms there is utilised the physical effect that aerosol particles tend to adhere to ions, and thus, reduce the ionization current flowing within an ionization chamber. In the case of optical smoke detectors there is utilised the effect that the light is scattered at the aerosol particles, and there is employed for alarm-giving purposes either the change in intensity of a light beam or the intensity of the scattered light.

Experiments carried out in connection with fires or combustion processes have surprisingly demonstrated that independent of the intensity of smoke development the quotient formed from the electrical signals delivered by two smoke sensor elements operating according to different functional principles, experiences a surge-like or sudden change whenever the combustion process undergoes a transition from the smoldering phase into the open phase. Therefore, it is possible by forming the quotient and evaluating the same to directly recognise whether the detected smoke emanates from a smoldering fire or a fire having open flames (absolute magnitude of the signal), or if a fire has changed-over from the smoldering phase into the phase containing open flames (change of the signal magnitude as a function of time).

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various embodiments there have been generally used the same reference characters to denote the same analogous components and wherein.

DETAILED DESCRIPTION OF THE PREFERRED EMBODIMENTS

Figure 1:
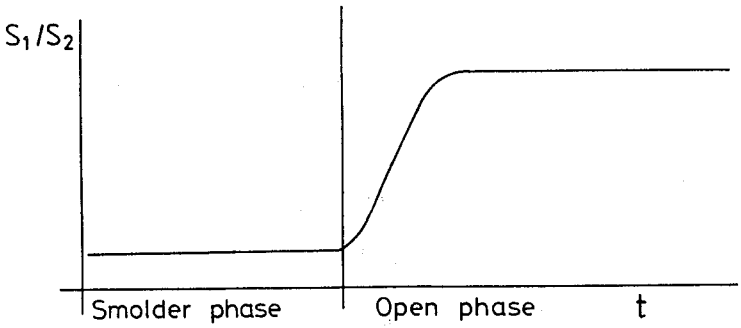
FIG. 1 is a diagram illustrating the course as a function of time of the quotient of the signals obtained from sensor elements or feelers operating according to different functional principles upon transition of the fire or combustion process from a smoldering fire into an open fire.

Describing now the drawings, in FIG. 1 there has been illustrated the temporal or timewise course of the quotient $Q=s_1/s_2$. Reference character $s_1$ signifies for instance, the electrical signal of a sensor element having an air-accessible ionization chamber, and reference character $s_2$ designates the electrical signal of a sensor element containing a photoelectric transducer. The surge-like change in the magnitude of the quotient Q denotes the transition of the combustion process or fire from the smoldering phase to the open flame condition. It should be understood that upon interchanging the electrical signals the absolute value of Q assumes a high value during the smoldering phase and upon transition of the combustion process into the phase containing open or licking flames returns or descends in a surge-like or sudden fashion. However, what is characteristic in each instance is that there is a surge or jump-like change in the absolute value of Q.

Figure 2:
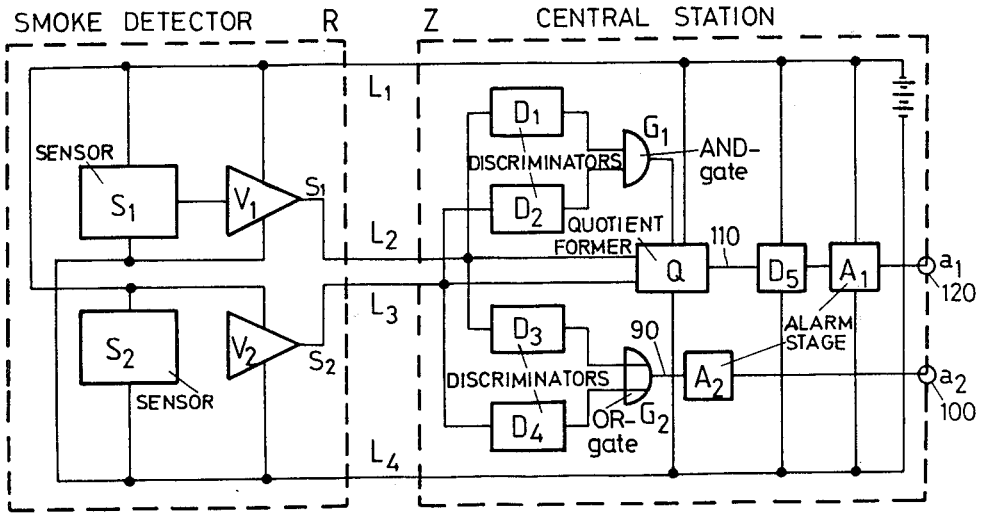
FIG. 2 is a principle circuit diagram of a fire alarm installation constructed according to the invention.

FIG. 2 illustrates a smoke alarm installation wherein a smoke detector R is connected by means of four lines or conductors $L_1$, $L_2$, $L_3$ and $L_4$ with a central signal station or central station Z. Located within the smoke detector R are both of the smoke sensors or feelers $S_1$ and $S_2$. The not particularly referenced outputs of the sensor elements $S_1$ and $S_2$ are each connected with a respective amplifier $V_1$ and $V_2$. The electrical signals $s_1$ and $s_2$ which are delivered by the amplifiers $V_1$ and $V_2$, respectively, are conducted by means of the lines or conductors $L_2$ and $L_3$ to the central signal station Z, where they are infed to conventional discriminators $D_1$, $D_2$, $D_3$, $D_4$ and a suitable quotient forming stage or quotient former Q ($s_1/s_2$) of an evaluation circuit. The task of the discriminators $D_1$ and $D_2$ resides in preventing, by means of the AND-gate $G_1$, that there will be delivered an electrical signal from the quotient forming or former stage Q when the absolute value of the signals $s_1$ and $s_2$ remains below predetermined values or thresholds, i.e. the signals $s_1$ and $s_2$ must both exceed the threshold values set at the discriminators $D_1$ and $D_2$ in order for there to be accomplished quotient formation.

The task of the discriminators $D_3$ and $D_4$ resides in triggering or giving an alarm upon the signals $s_1$ or $s_2$ exceeding predetermined absolute values. To this end the not particularly referenced outputs of the discriminators $D_3$ and $D_4$ are connected with an OR-gate $G_2$, the output 90 of which controls an alarm stage $A_2$. This alarm stage $A_2$ generates an appropriate alarm signal $a_2$ which can be removed at the output 100 of the central signal station Z.

The output 110 of the quotient former Q is connected with a discriminator $D_5$. The function of the discriminator $D_5$ resides in triggering an alarm signal when the signal delivered by the quotient former or quotient forming stage Q exceeds a predetermined value. If there is exceeded the threshold value set at the discriminator $D_5$, then there is delivered an electrical signal to the alarm stage $A_1$. The alarm stage $A_1$, in turn delivers an alarm signal $a_1$ which can be removed at the output 120 of the central signal station Z.

In FIG. 2 there has been illustrated the connection of a single smoke detector R at the central signal station Z. At the lines $L_1$ and $L_4$ there can be, however, connected further smoke sensors $R_2 \ldots R_n$. In such case the transmission of the signals s can be accomplished, for instance, by way of a multiplex technique as is usual in the data transmission technology.

Figure 3:
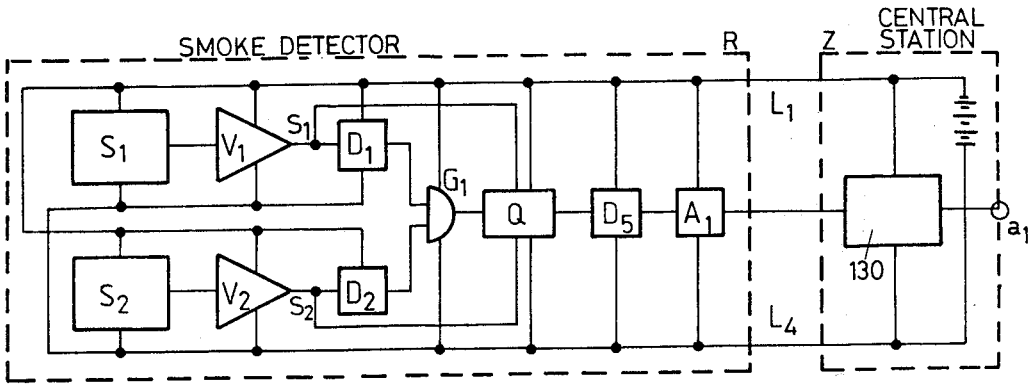
FIGS. 3 and 4 illustrate principle circuit diagrams of smoke detectors of the fire alarm installation according to the invention.

FIG. 3 illustrates the principle circuit diagram of a fire alarm installation according to the invention, wherein here a predominant part of the evaluation circuit is located in the smoke detector or alarm R. The smoke detector R possesses two sensor or feeler elements $S_1$ and $S_2$, the output signals of which are infed in each case to the related amplifiers $V_1$ and $V_2$, respectively. The amplified electrical signals $s_1$ and $s_2$ are delivered to the quotient former stage Q ($=s_1/s_2$) and to the discriminators $D_1$ and $D_2$. The function of the discriminators $D_1$ and $D_2$ resides in ensuring, by means of the AND-gate $G_1$, that there will only be formed the quotient from the signals $s_1$ and $s_2$ whenever the absolute value of such signals exceeds a predetermined minimum value or threshold. The quotient of the electrical signals $s_1$ and $s_2$, formed by the quotient former stage Q, is infed in the form of a quotient-electrical signal to the discriminator $D_5$. The function of the discriminator $D_5$ resides in ensuring that an alarm signal will be transmitted to the alarm stage $A_1$ upon exceeding a predetermined value of the quotient. The output signal from the alarm stage $A_1$ is delivered by means of a separate line to the central signal station Z where there can be displayed or otherwise appropriately indicated an alarm state at any suitable alarm indicator 130. Also with this embodiment there can be grouped together into a group a number of smoke detectors or alarms and such can be connected by means of the same lines or conductors with the central signal station Z.

Figure 4:
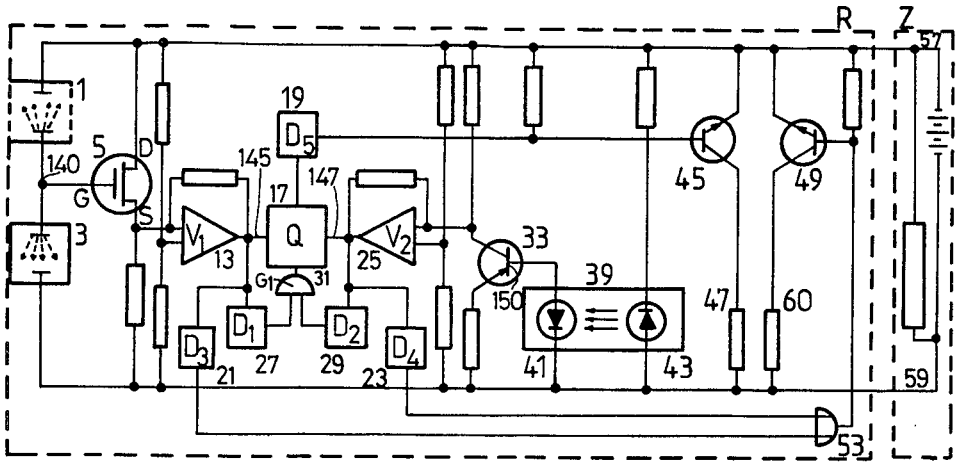

FIG. 4 illustrates a circuit diagram of a preferred embodiment of fire alarm constructed according to the invention. Here there are used as the smoke-sensitive sensors of the fire alarm an ionization chamber 1 and a photoelectric transducer 39. The ionization chamber 1 is connected in series with a second ionization chamber, the so-called reference chamber 3, which is not accessible to the ambient air and serving as a comparison resistance or resistor, and the common node or connection point 140 of both chambers 1 and 3 is electrically connected with the gate G of a field-effect transistor 5 serving as an impedance converter. At the source electrode S of the field-effect transistor 5 there is removed the low-ohm signal of the measuring or ionization chamber 1 and infed to an amplifier 13. The amplifier 13 amplifies this signal $s_1$ to a desired value and delivers it to a first input 145 of the quotient former 17.

The photoelectric transducer 39 is provided with a light-emitting diode 43 and a solar cell 41. The electrical signal $s_2$ delivered by the solar cell 41 corresponds in its magnitude to the received light intensity. If smoke penetrates into the measuring path, i.e. the measuring or ionization chamber 1, then the potential of the solar cell 41 is reduced, and thus, the potential at the base 150 of the transistor 33. The amplified electrical signal $s_2$, which is opposite in phase, is infed to the amplifier 25 where it is likewise amplified in desired manner and delivered to a second input 147 of the quotient former 17. The signals delivered by both of the amplifying stages or amplifiers 13 and 25 are infed in each case to a respective discriminator 27 and 29. The task of the discriminators 27 and 29 resides in preventing, by means of the AND-gate 31, that an electrical signal is delivered by the quotient forming stage or quotient former 17 when the absolute value of the signals $s_1$ and $s_2$ remains below predetermined values or thresholds.

The output signal of the quotient former 17 is proportional to the ratio of both input signals $s_1/s_2$. If this ratio or relationship exceeds a predetermined value, then the discriminator 19 turns-on the transistor 45, which leads to a current flow across the load resistance or resistor 47. This current, which indicates the transition from the smoldering phase to the open fire phase, is evaluated in the central signal station 55 as an alarm signal.

The signals $s_1$ and $s_2$ are furthermore infed to both of the further discriminators 21 and 23, the outputs of which are connected with an OR-gate 53. If the absolute value of the electrical signal $s_1$ or the electrical signal $s_2$ exceeds a maximum value which has been set at the discriminators 21 and 23, respectively, then the OR-gate 53 turns-on the transistor 49, leading to a current flow across the load resistance or resistor 60 and to the giving of an alarm signal at the central signal station 55 which is correspondingly different from the first alarm signal.

Due to this circuit configuration there is obtained the result that an alarm signal is given or triggered in the central signal station 55 whenever either the signal of the ionization chamber 1 or the signal of the photoelectric transducer 39 exceeds a predetermined value or, however, when the ratio of the value of the signal of the photoelectric transducer 39 in relation to the magnitude of the signal of the ionization chamber 1, i.e. the ratio $s_1$ to $s_2$, exceeds a predetermined value or threshold.

Figure 5:
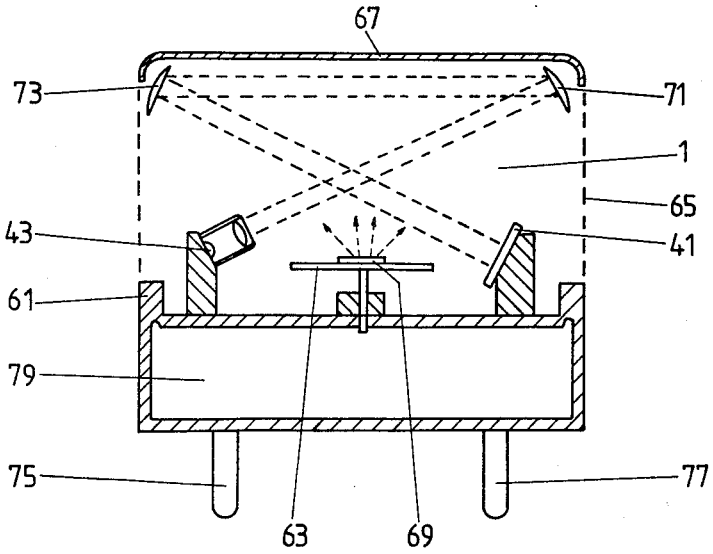
FIG. 5 illustrates in cross-sectional view a fire alarm for use in the fire alarm installation of the invention.

FIG. 5 illustrates a cross-section through a fire alarm constructed according to the invention, wherein ionization chamber 1 contains the photoelectric transducer composed of light-emitting diode 43 and solar cell 41, i.e. the ionization chamber 1 and the photoelectric transducer 39 are housed in a housing 61 which is accessible to the ambient atmosphere or surroundings. The ionization chamber 1 is formed by an electrode 63 and a wire grid 65 serving as a counter electrode. Depending upon the intended field of application it is possible for the housing cover 67 itself or in conjunction with the wire grid 65 to serve as the counter electrode. Arranged upon the electrode 63 is a radioactive source 69 serving for ionizing the space or region between the electrodes 63 and 65 or 67, as the case may be.

The light-emitting diode 43 emits a substantially parallel beam of light which is reflected by means of a reflector or mirror 71 on to a reflector or mirror 73 and then upon the solar cell 41. The contacts or connections 75 and 77 serve for voltage supply purposes and for further conducting the alarm signal by means of the lines 57 and 59 to the central signal station 55.

The base portion 79 of the housing 61 contains the not here further illustrated reference chamber as well as the evaluation circuit, as for instance has been described previously in detail in conjunction with FIG. 4.

If smoke penetrates through the wire grid or mesh 65 into the ionization chamber 1, then due to the deposition of aerosol particles at the ions there is reduced, as is well known, the ionization current flow of the measuring chamber, and also by virtue of a reduction of the light impinging at the solar cell 41 there is likewise a reduction in the potential of the solar cell 41. The electrical signals delivered by the ionization chamber 1 and the photoelectric transducer 39 are then evaluated in the manner described above in conjunction with FIG. 4.

While there are shown and described present preferred embodiments of the invention, it is to be distinctly understood that the invention is not limited thereto, but may be otherwise variously embodied and practiced within the scope of the following claims.

Accordingly, what I claim is:

1. In a method for fire detection, wherein an electrical signal is generated as a function of combustion phenomena by a fire alarm installation containing at least two sensors responsive to different combustion phenomena and a common evaluation circuit for the evaluation of the condition changes of the sensors and for giving an alarm signal, the sensors operating according to respectively different principles and delivering respective electrical output signals as a function of the condition changes of the sensors resulting from detected combustion phenomenon, the improvement which comprises the steps of:

forming the quotient of the electrical signals delivered by the two sensors, in order to detect the transition from one type of combustion phenomenon to another type of combustion phenomenon; and generating an alarm signal when the quotient exceeds a predetermined value or there arises a rapid change in the quotient.

2. The method as defined in claim 1, further including the steps of:

utilizing as the two sensors respective photoelectric transducers operating according to said respectively different principles.

3. The method as defined in claim 1, further including the steps of:

utilizing as one of the sensors a photoelectric transducer and as the other sensor an air-accessible ionization chamber.

4. The method as defined in claim 1, further including the steps of:

suppressing the generation of an alarm signal when instantaneous values of the electrical signals delivered by the sensors remain below a predetermined value.

5. The method as defined in claim 1, further including the steps of:

utilizing said two sensors in conjunction with a respective amplification element and with said sensors and amplification elements arranged in a fire alarm;

providing a central signal station;

connecting a number of said fire alarms by means of common lines with said central signal station; and transmitting the electrical signals from the fire alarms to the central signal station.

6. The method as defined in claim 5, further including the steps of:

arranging the evaluation circuit at the central signal station; and transmitting instantaneous values of the electrical signals generated by the sensors to the evaluation circuit.

7. The method as defined in claim 4, further including the steps of:

providing a central signal station;

forming said quotient of the electrical signals generated by both sensors in a fire alarm; and transmitting the instantaneous values of the electrical signals produced by the sensors and the quotient of the sensor signals to circuit elements provided at the central signal station and which circuit elements generate an alarm signal.

8. A fire alarm installation comprising:

at least two sensor elements working according to different operating principles and delivering respective electrical output signals as a function of the detected combustion phenomena;

a common evaluation circuit cooperating with said two sensor elements and serving for the evaluation of the condition changes of the sensor elements and for giving a signal; and said evaluation circuit containing circuit elements which form the quotient of the electrical signals delivered by said at least two sensor elements, in order to detect the transition from one type of combustion phenomenon to another type of combustion phenomenon.

9. The fire alarm installation as defined in claim 8, wherein:

said at least two sensor elements comprise a first sensor element constituted by an air-accessible ionization chamber and a second sensor element constituted by a photoelectric transducer operating according to the extinction principle.

10. The fire alarm installation as defined in claim 8, wherein:

said two sensor elements comprise a first sensor element constituted by an air-accessible ionization chamber and a second sensor element constituted by a photoelectric transducer operating according to the scattered light principle.

11. The fire alarm installation as defined in claim 8, wherein:

said two sensor elements comprise a first sensor element constituted by a photoelectric transducer operating according to the extinction principle and a second sensor element constituted by a photoelectric transducer operating according to the scattered light principle.

12. The fire alarm installation as defined in claim 8, further including:

a respective signal amplifying element provided for each sensor element;

both of said sensor elements together with their amplification elements being arranged in a fire alarm housing;

a central signal station; and said common evaluation circuit being located at the central signal station.

13. The fire alarm installation as defined in claim 8, wherein:

said two sensor elements are conjointly arranged within a common fire alarm housing;

a central signal station; and said common evaluation circuit being arranged at the central signal station.

14. The fire alarm installation as defined in claim 8, wherein:

said at least two sensor elements are arranged in neighbouring relationship at a region which is to be monitored;

a central signal station;

each of said two neighbouring arranged sensor elements being connected in pairs by line means with the central signal station; and said central signal station containing said common evaluation circuit.

15. The fire alarm installation as defined in claim 8, further including:

a central signal station;

means for transmitting instantaneous values of the sensor element signals to the central signal station;

said two sensor elements and said transmitting means being arranged within a fire alarm housing;

said central signal station containing circuit elements which, upon exceeding a predetermined value of the instantaneous values of the sensor element signals, give an alarm signal; and said central signal station containing said circuit elements which form the quotient of said electrical signals defining instantaneous signals obtained from both sensor elements and upon exceeding a predetermined value of said quotient giving an alarm signal differing from the first mentioned alarm signal.

16. The fire alarm installation as defined in claim 8, further including:

a central signal station;

a respective amplifier circuit provided for each of said sensor elements;

said circuit elements of said evaluation circuit comprising:

discriminator means;

a quotient former;

said two sensor elements along with said respective amplifier circuits, said discriminator means, said quotient former being arranged within a fire alarm housing;

circuit elements arranged at the central signal station for generating an alarm signal when the instantaneous values of the electrical signals of the sensor elements have exceeded a predetermined value;

further circuit elements arranged at said central signal station which produce an alarm signal differing from the first mentioned alarm signal when the quotient of the electrical signals delivered by the sensor elements exceed a predetermined value.

17. The fire alarm installation as defined in claim 16, wherein:

said evaluation circuit contains circuit elements which, when the sensor element signals exceed a predetermined value and when the quotient of the sensor element signals exceed a predetermined value, produce different signals which can be transmitted to the central signal station.

18. The fire alarm installation as defined in claim 8, further including:

means for suppressing the quotient formation when absolute values of the sensor element signals remain below predetermined values.

* * * * *